US010351280B2

(12) United States Patent
Prahm et al.

(10) Patent No.: US 10,351,280 B2
(45) Date of Patent: Jul. 16, 2019

(54) METHOD FOR HANDLING CONTAINERS, IN PARTICULAR CARDBOARD BOXES, FOR GROUPS OF OBJECTS, IN PARTICULAR PACKAGES

(71) Applicant: Focke & Co. (GmbH & Co. KG), Verden (DE)

(72) Inventors: Andreas Prahm, Barssel (DE); Dennis Schmidt, Westoverledingen (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 656 days.

(21) Appl. No.: 14/785,189

(22) PCT Filed: Apr. 29, 2014

(86) PCT No.: PCT/EP2014/001144
§ 371 (c)(1),
(2) Date: Oct. 16, 2015

(87) PCT Pub. No.: WO2014/183834
PCT Pub. Date: Nov. 20, 2014

(65) Prior Publication Data

US 2016/0083129 A1 Mar. 24, 2016

(30) Foreign Application Priority Data

May 15, 2013 (DE) ..... 10 2013 105 002

(51) Int. Cl.
*B65B 5/06* (2006.01)
*B65B 5/10* (2006.01)
(Continued)

(52) U.S. Cl.
CPC ..... *B65B 43/46* (2013.01); *B65B 5/06* (2013.01); *B65B 5/10* (2013.01); *B65B 35/10* (2013.01);
(Continued)

(58) Field of Classification Search
CPC ..... B65B 5/08; B65B 35/10; B65B 43/46; B65B 43/54
(Continued)

(56) References Cited

U.S. PATENT DOCUMENTS 4,010,594 A * 3/1977 Boyd ..... B65B 43/48 141/1
4,776,148 A * 10/1988 Mingozzi ..... B65B 5/105 53/143
(Continued)

FOREIGN PATENT DOCUMENTS

CN 1223220 A 7/1999
CN 1922088 A 2/2007
(Continued)

OTHER PUBLICATIONS

Industria Y Comercio (Colombia Patent Office), Search in a related application, ~Aug. 2017.
(Continued)

*Primary Examiner* — Gloria R Weeks
*Assistant Examiner* — Patrick B Fry
(74) *Attorney, Agent, or Firm* — Laurence P. Colton; Smith Tempel Blaha LLC

(57) ABSTRACT

A and device method for handling containers, in particular cardboard boxes, for groups of objects, in particular packages, in which the objects are inserted one after another into the container and are deposited there in an ordered formation, and in which the containers are held ready in each case by a handling device, in particular a cardboard box robot, for the insertion of the objects, and in each case several containers are held ready at the same time by the handling device so that they can be filled with objects.

4 Claims, 6 Drawing Sheets

(51) Int. Cl.

| | |
|---|---|
| ***B65B 35/10*** | (2006.01) |
| ***B65B 35/56*** | (2006.01) |
| ***B65B 43/46*** | (2006.01) |
| ***B65B 43/56*** | (2006.01) |
| ***B65B 59/00*** | (2006.01) |
| ***B65B 65/00*** | (2006.01) |

(52) U.S. Cl.
CPC ..... *B65B 35/56* (2013.01); *B65B 43/56* (2013.01); *B65B 59/00* (2013.01); *B65B 65/003* (2013.01)

(58) Field of Classification Search
USPC ..... 53/475, 244, 250; 198/419.1
See application file for complete search history.

(56) References Cited

U.S. PATENT DOCUMENTS 4,800,703 A * 1/1989 Goodman ..... B65B 5/08 53/244
4,862,677 A * 9/1989 Roberts ..... B65B 5/106 53/245
5,360,306 A * 11/1994 Nakayama ..... B65G 49/085 198/419.1
5,515,664 A * 5/1996 Tanaka ..... B65B 5/06 53/243
5,778,640 A * 7/1998 Prakken ..... B65B 5/061 53/244
5,822,953 A 10/1998 Kagawa
5,927,053 A * 7/1999 Donovan ..... B65B 35/40 53/168
6,003,286 A 12/1999 Goodman
6,094,885 A * 8/2000 Ranhotra ..... B65B 43/42 53/244
6,438,928 B1 * 8/2002 Huang ..... B65B 5/108 53/249
7,021,036 B2 * 4/2006 Hiramoto ..... B65B 43/04 493/186
9,334,070 B2 * 5/2016 Till ..... B65B 5/061
9,745,146 B2 * 8/2017 Schaeuble ..... B65G 47/91
9,789,983 B2 * 10/2017 Brandhorst ..... B65B 35/18
2012/0037481 A1 * 2/2012 He ..... B65G 47/642 198/890.1
2013/0283731 A1 * 10/2013 Komp ..... B65B 5/06 53/268
2016/0107781 A1 4/2016 Krones

FOREIGN PATENT DOCUMENTS

| | | | |
|---|---|---|---|
| CN | 101977816 | A | 2/2011 |
| DE | 10113080 | A1 | 9/2002 |
| DE | 102008010432 | A1 | 8/2009 |
| DE | 202010000056 | U1 | 8/2011 |
| DE | 102011015741 | B4 | 1/2013 |
| DE | 102012006278 | A1 | 10/2013 |
| EP | 0909706 | A1 | 4/1999 |
| EP | 0915012 | A1 | 5/1999 |
| EP | 1718549 | A1 | 11/2006 |
| EP | 2520497 | A1 | 11/2012 |
| EP | 2586712 | A1 | 5/2013 |
| WO | 2005080239 | A1 | 9/2005 |

OTHER PUBLICATIONS

Chinese Patent Office, Examination Report on related application, dated Jun. 23, 2017.
Deutsches Patent—Und Markenamt (German Patent and Trademark Office), Recherchebericht (Search on priority application), dated Mar. 11, 2014.
State Intellectual Property Office of the People's Republic of China, Notification of the First Office Action (in a related patent application), dated Aug. 31, 2016.
Studio Torta, Remarks Concerning the Patentability of International Patent Application PCT/EP2014/00114 according to Art. 115 EPC (remarks submitted by a competitor's lawfirm), May 9, 2017.

* cited by examiner

METHOD FOR HANDLING CONTAINERS, IN PARTICULAR CARDBOARD BOXES, FOR GROUPS OF OBJECTS, IN PARTICULAR PACKAGES

STATEMENT OF RELATED APPLICATIONS

The application is the US National Phase of International Application No. PCT/EP2014/001144 having an International Filing Date of 29 Apr. 2014, which claims priority on German Patent Application No. 102013105002.6 having a filing date of 15 May 2013.

BACKGROUND OF THE INVENTION

Technical Field

The invention relates to a method for handling containers, in particular cardboard boxes, for groups of objects, in particular packages, wherein the objects are inserted one after another into the container and are deposited there in an ordered formation, and wherein the containers are held ready in each case by a handling device, in particular a cardboard box robot, for the insertion of the objects. In addition, the invention relates to a device for handling containers, in particular cardboard boxes, for groups of objects, in particular packages, wherein the objects are inserted one after another into the container and are deposited there in an ordered formation, having a handling device, in particular a cardboard box robot, for holding the containers ready for the insertion of the objects.

Prior Art

Methods and devices of the type mentioned in the introduction are known from practice.

BACKGROUND OF THE INVENTION

The object underlying the invention is to develop the known methods and devices further.

To achieve said object, a method according to the invention comprises the features of a method for handling containers, in particular cardboard boxes, for groups of objects, in particulars packages, wherein the objects are inserted one after another into the container and are deposited there in an ordered formation, and wherein the containers are held ready in each case by a handling device, in particular a cardboard box robot, for the insertion of the objects, characterized in that in each case several containers are held ready at the same time by the handling device so that they can be filled with objects. It is accordingly provided that in each case several containers are held ready at the same time by the handling device so that they can be filled with objects.

The advantage of said solution, in particular, is that the filling operation runs altogether faster as a smaller number of cardboard box changing operations is necessary. Said solution is also more cost-efficient than the prior art solution of using several handling devices which in each case handle one cardboard box at a time. As a result, the throughput could certainly also be increased but a corresponding number of additional handling devices would be necessary for this purpose.

A further characteristic can consist in that the containers are held ready at a spacing from one another so that they can be grasped by means of the handling device, wherein the spacing between the containers with respect to one another when being held ready corresponds to the spacing between the containers with respect to one another during the subsequent filling process.

It can preferably be provided that the containers are held by pneumatically operating gripping members when being held ready so that they can be grasped by the handling device, wherein the containers are preferably first of all accumulated and in each case grasped by a gripping member and are then moved to the spacing with respect to one another by corresponding movement of at least one gripping member.

According to a preferred exemplary embodiment, it is provided that at least one container is grasped at an inner wall by a gripping member, and that the gripping member is displaced laterally by means of the gripping member so as to space the container from an adjacent container, and that, during the subsequent removal out of the container, the gripping member is initially moved away from the inner wall and then withdrawn.

A further characteristic can consist in that the objects are supplied on a feed conveyor and are then shifted at an angle, in particular transversely, on a cross conveyor, and that, as a result of abutting against stops, the objects are held ready in the region of the cross conveyor at a spacing with respect to one another which corresponds to the spacing between containers.

According to a preferred further development, it is provided that at least one stop is arranged in an immovable manner, and that at least one further stop is arranged so as to be movable and is moved into the conveying path of the objects in order to position an object at a predefined spacing to another object which abuts against the immovable stop.

In a particularly preferred development of the method, it is provided that the objects are supplied on a central feed conveyor and are shifted onto two cross conveyors and from there are inserted into the containers, wherein each cross conveyor has associated therewith in each case one handling device, and the handling devices hold containers ready for filling in an alternating manner and deposit them one after another on a conveying device for filled containers.

A device according to the invention for achieving the object mentioned in the introduction comprises a handling device, in particular a cardboard box robot, for the insertion of the objects, characterized in that in each case several containers are held ready at the same time by the handling device so that they can be filled with objects. It is accordingly provided that the handling device comprises means, in particular one or several gripping heads, for holding several containers ready at the same time, preferably for filling them simultaneously with objects.

According to a preferred embodiment of the device, the following features are provided:

a) a preferably central feed conveyor for supplying the objects, b) one or several cross conveyors connecting to the feed conveyor for discharging the objects in a lateral manner, c) stops in the region of the cross conveyors for stopping the objects at a spacing with respect to one another which corresponds to the spacing between the containers held ready by the handling device, d) gripping members for holding several containers ready to be grasped by a handling device.

According to an advantageous embodiment, it can be provided that two cross conveyors extend on both sides of the feed conveyor, and that each cross conveyor has associated therewith one handling device for holding in each case several containers ready so that said containers can be filled simultaneously with objects.

It is preferably provided that both handling devices remove the containers in each case in pairs one after another from a central cardboard box station.

A further characteristic can consist in that in the region of the or of each cross conveyor a handling device for the objects, in particular a package robot, is provided for conveying the same into the containers, wherein the objects are preferably pushed by means of the handling device over a guiding member which projects into the containers that are held ready, wherein insertion aids are preferably provided for holding open folding tabs of the containers.

According to a preferred embodiment, it is provided that gripping heads of the handling device for the containers grip several containers simultaneously and handle them for filling.

According to a further preferred embodiment, it is provided that the or each handling device for the objects is set up for handling several objects simultaneously, wherein the number of objects handled simultaneously corresponds to the number of containers that are simultaneously held ready.

BRIEF DESCRIPTION OF THE DRAWINGS

Further characteristics are produced moreover from the sub-claims, the following description as well as the drawing of a preferred exemplary embodiment, in which:

DETAILED DESCRIPTION OF PREFERRED EMBODIMENTS

Figure 1:
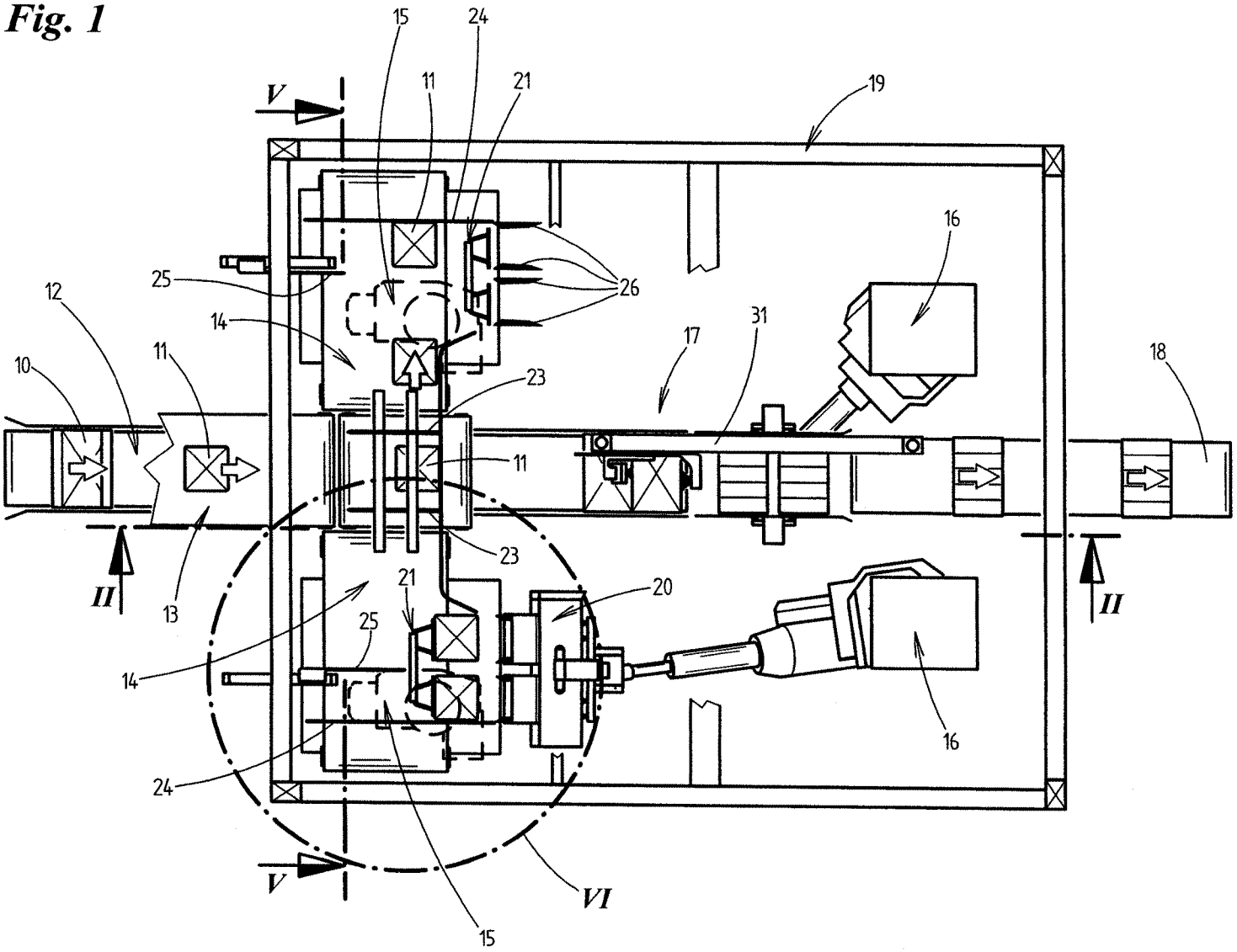
FIG. 1 shows a top view of a device for packaging objects in cardboard boxes.
Figure 2:
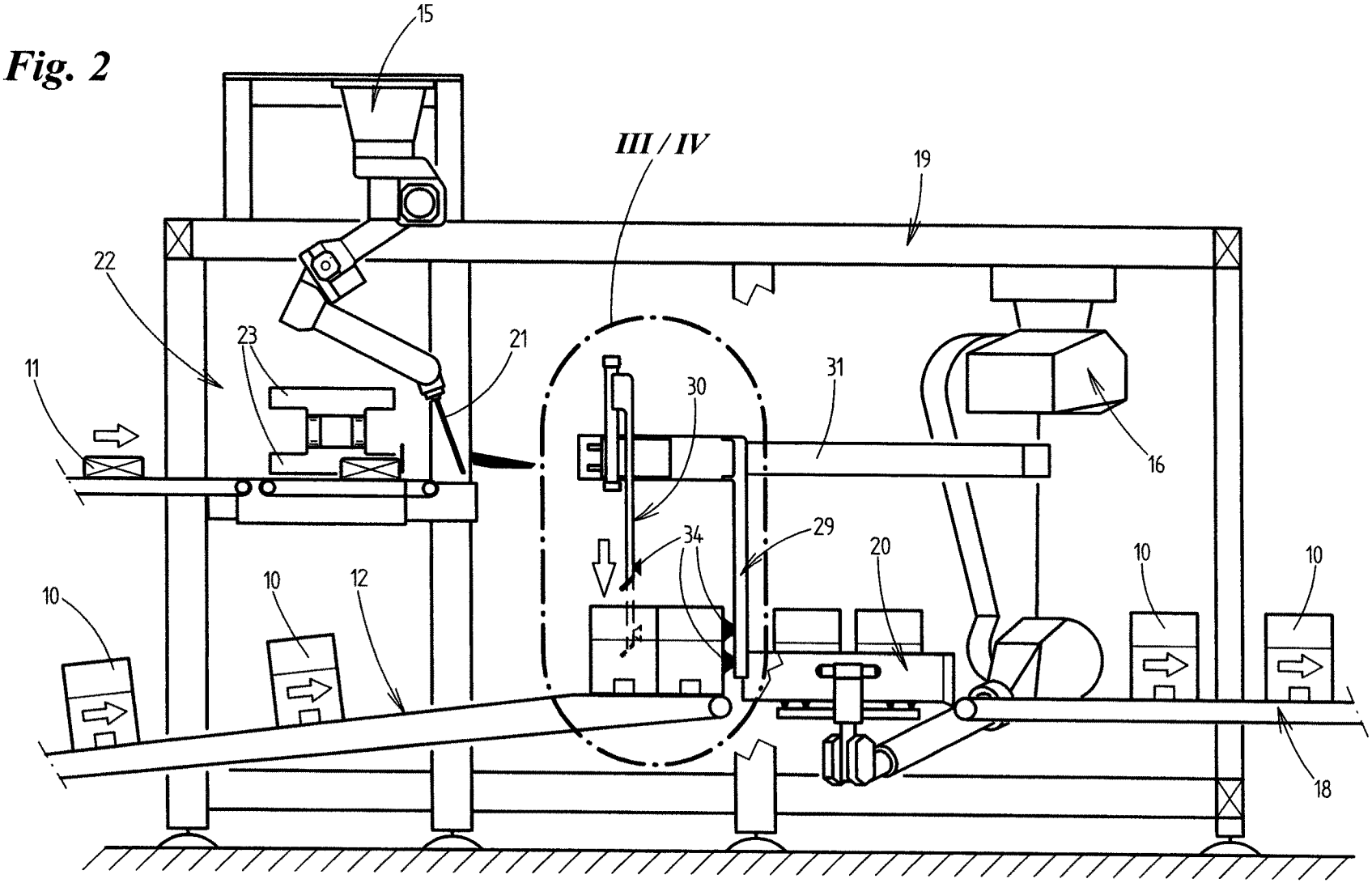
FIG. 2 shows a vertical section through the device along the line of intersection II-II in FIG. 1, FIGS. 3 and 4 show a detail of the device according to the marking in FIG. 2.
Figure 4:
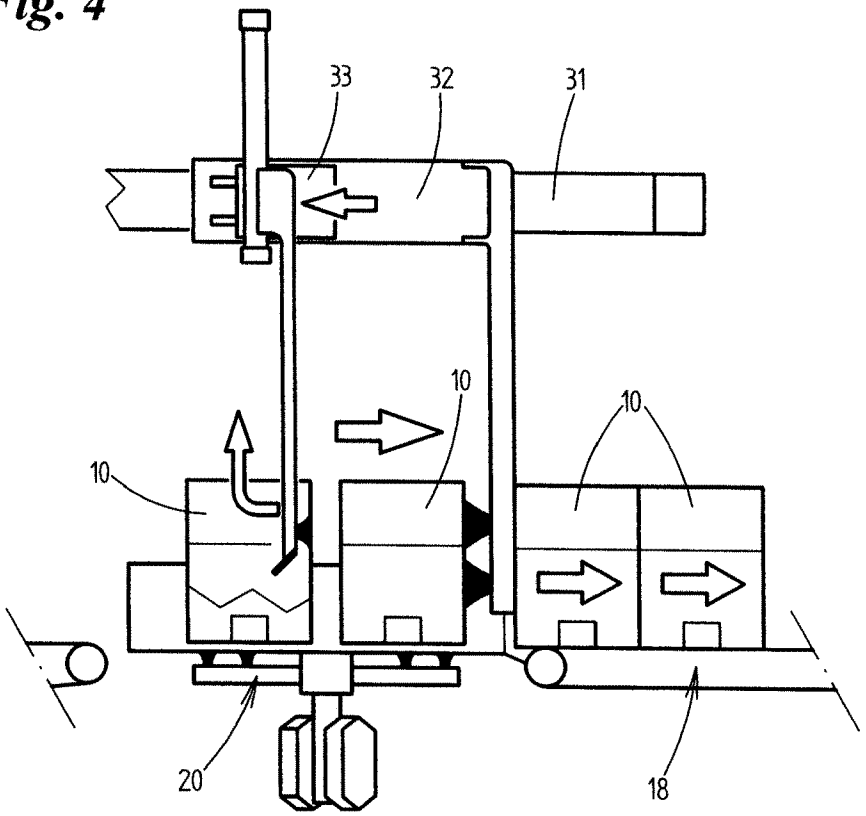
Figure 3:
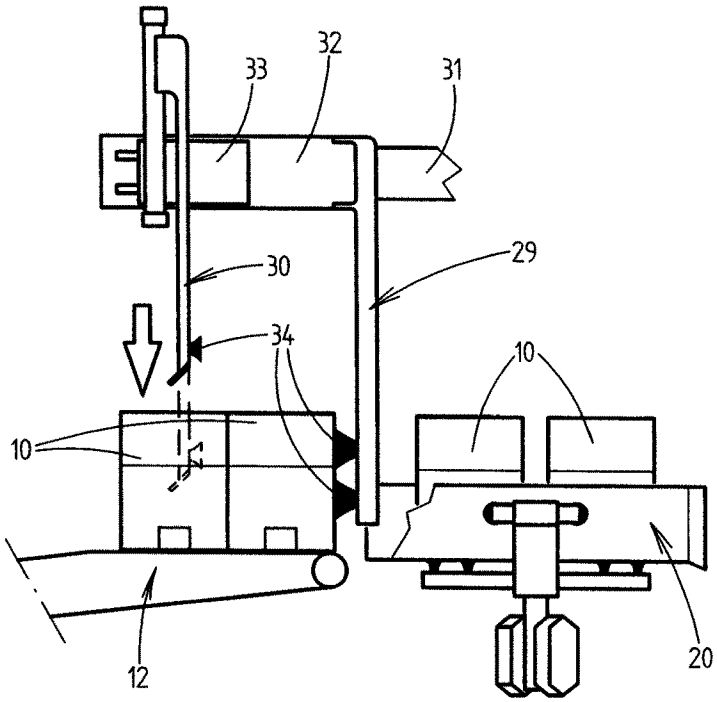

The exemplary embodiment shown is concerned with the filling of containers with a plurality of objects. The containers are preferably cardboard boxes 10. The objects in the exemplary embodiment shown are packages 11. These can be realized, for example, as bags and comprise a rectangular-shaped, preferably flat form. The objects are to be accommodated in the container in such a manner that said container is filled in an optimum manner. The containers are then closed and taken away.

The description of the preferred exemplary embodiment below refers to the terms cardboard box 10 and package 11. It is obvious that these are utilized synonymously for the generic terms container and object.

Essential components of the device are a feed conveyor 12 for empty, non-filled cardboard boxes 10, a feed conveyor 13 for packages 11, two cross conveyors 14 for the packages 11, handling devices for the packages 11 in the form of package robots 15, handling devices for the cardboard boxes 10 in the form of cardboard box robots 16 as well as a cardboard box station 17 and a discharging conveyor 18 for filled cardboard boxes 10. Individual units are arranged inside a machine frame 19 or are connected to said machine frame.

Core units of the device are the handling devices for the cardboard boxes 10 and for the packages 11. The handling devices are realized such that, on the one hand, the cardboard boxes 10 and, on the other hand, the packages 11 are able to carry out complex movements which are tuned to one another when the packages 11 are inserted into the cardboard boxes 10. To this end, both handling devices are realized as robots which have several carrying arms or booms and consequently are pivotable in the vertical direction and horizontal direction and, over and above this, are length-adjustable. The cardboard box robots 16 additionally comprise a gripping head 20 by way of which the cardboard boxes 10 can be grasped and held ready for filling.

A characteristic of the cardboard box robots 16 consists in that they are realized in each case for the purpose of handling several cardboard boxes 10 at the same time. It is conceivable, for example, for each of the cardboard box robots 16 to comprise one gripping head 20 which is able to grasp several cardboard boxes 10 at the same time or for each of the cardboard box robots 16 to comprise several gripping heads 20 which in each case grasp one cardboard box 10.

In the exemplary embodiment shown, the cardboard box robots 16 are set up to handle two cardboard boxes simultaneously in each case. However, a larger number of cardboard boxes which are handled simultaneously is also conceivable.

In the present case, the package robots 15 are also set up in such a manner that in each case several packages 11 are handled simultaneously, namely transferred to the cardboard boxes 10 which are held ready. In the present case, a double slider 21, by way of which two packages 11 are able to be inserted simultaneously into the cardboard box 10, is mounted in each case on the head of the package robots 15. Here too, the number of sliders can naturally be greater corresponding to the number of cardboard boxes 10 to be filled.

The feed conveyor 12 for the cardboard boxes 10 to be filled runs centrally through the machine frame 19 up to the cardboard box station 17. The discharging conveyor 18, which conveys the filled cardboard boxes 10 out of the machine frame 19, is arranged connecting to the cardboard box station 17. In the present case, the feed conveyor 12 and the discharging conveyor 18 extend, in this case, in an axis which separates the machine frame 19 into two halves.

The feed conveyor 13 for the packages 11 extends above the feed conveyor 12. The feed conveyor 13 ends (at a small spacing) above the cardboard box station 17. A cross conveyor 14 connects to the feed conveyor 13 in each case on both sides and said cross conveyors transport the packages 11 in the direction of a package robot 15. In order to shift the packages 11 from the feed conveyor 13 onto one of the cross conveyors 14, a cross conveyor 22, on the periphery of which entrainment means 23 are arranged for cross-shifting the packages 11, is arranged above the feed conveyor 13.

The individual packages 11, which are supplied one behind another at a spacing, are distributed in each case onto the two cross conveyors 14. So that two packages 11 are able to be grasped at the same time by a double slider 21 of a packing robot 15, the packages 11 are stopped at predefined positions. This is effected by means of a fixed stop 24 and a sliding stop 25 which is arranged in front of said fixed stop. The fixed stop 24 is arranged in an immovable and fixed manner such that, during transport, a package 11 is conveyed along the cross conveyor 14 against the fixed stop 24 and is held ready there in the correct position for the double slider 21. The sliding stop 25, in contrast, is moved into the conveying path of the packages 11 on the cross conveyor 14 once a package 11 has passed through such that a following package 11 is able to be stopped by the sliding stop 25. The two packages 11 on the fixed stop 24 and on the sliding stop 25 are then situated in the correct relative position with respect to one another such that the double slider 21 is able to convey the packages 11 together into the cardboard box 10. After this, the sliding stop 25 is moved back such that the next package 11 is able to be conveyed to the fixed stop 24.

When inserting the packages 11 into a cardboard box 10, on the one hand insertion aids 26 which hold the folding tabs of the cardboard box 10 open are used. On the other hand, the packages 11 are pushed into the cardboard boxes 10 over an insertion tongue 27, the insertion tongue 27 bridging the spacing between the cross conveyor 14 and the cardboard boxes 10.

Figure 5:
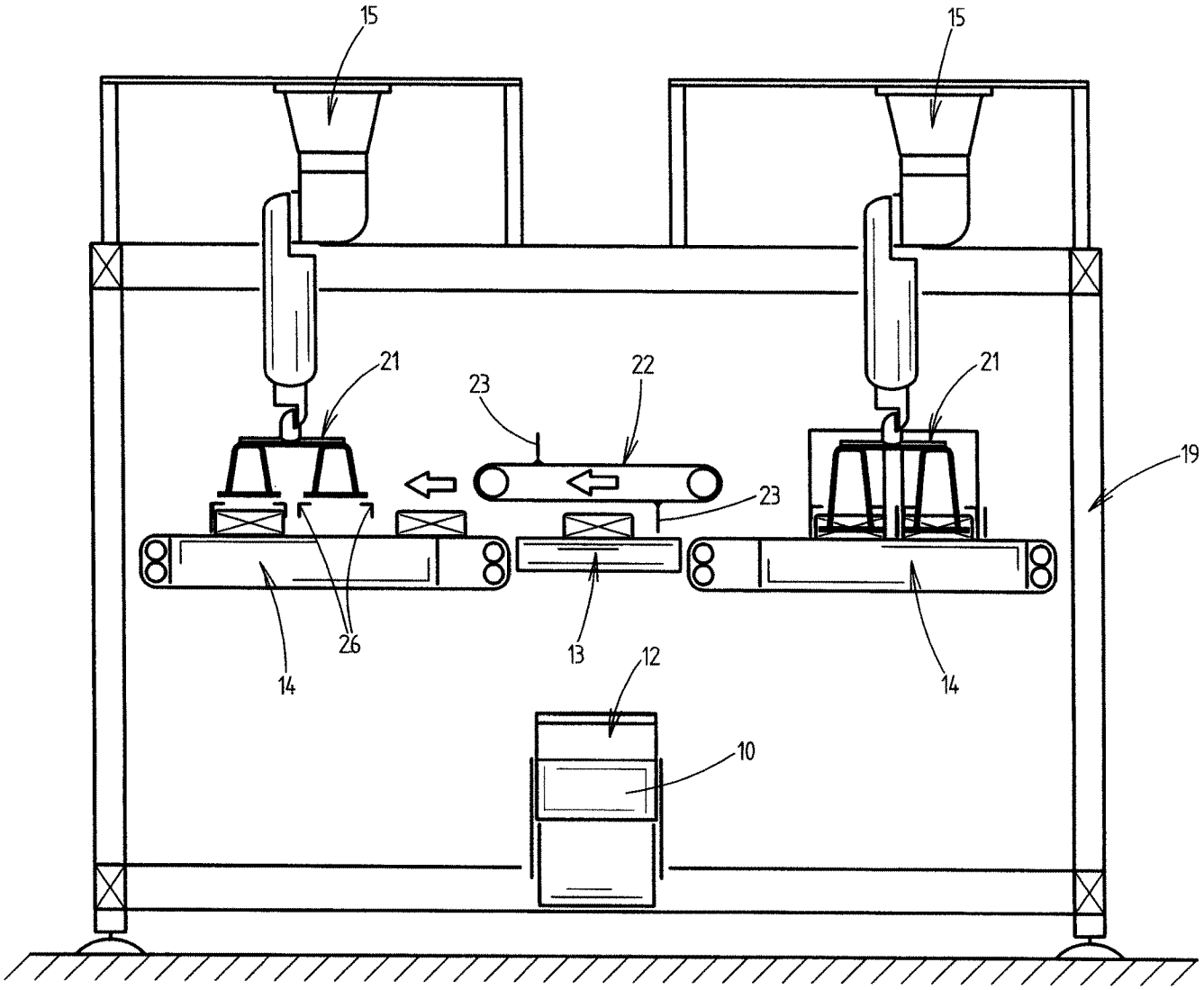
FIG. 5 shows a vertical section through the device along the line of intersection V-V in FIG. 1.
Figure 6:
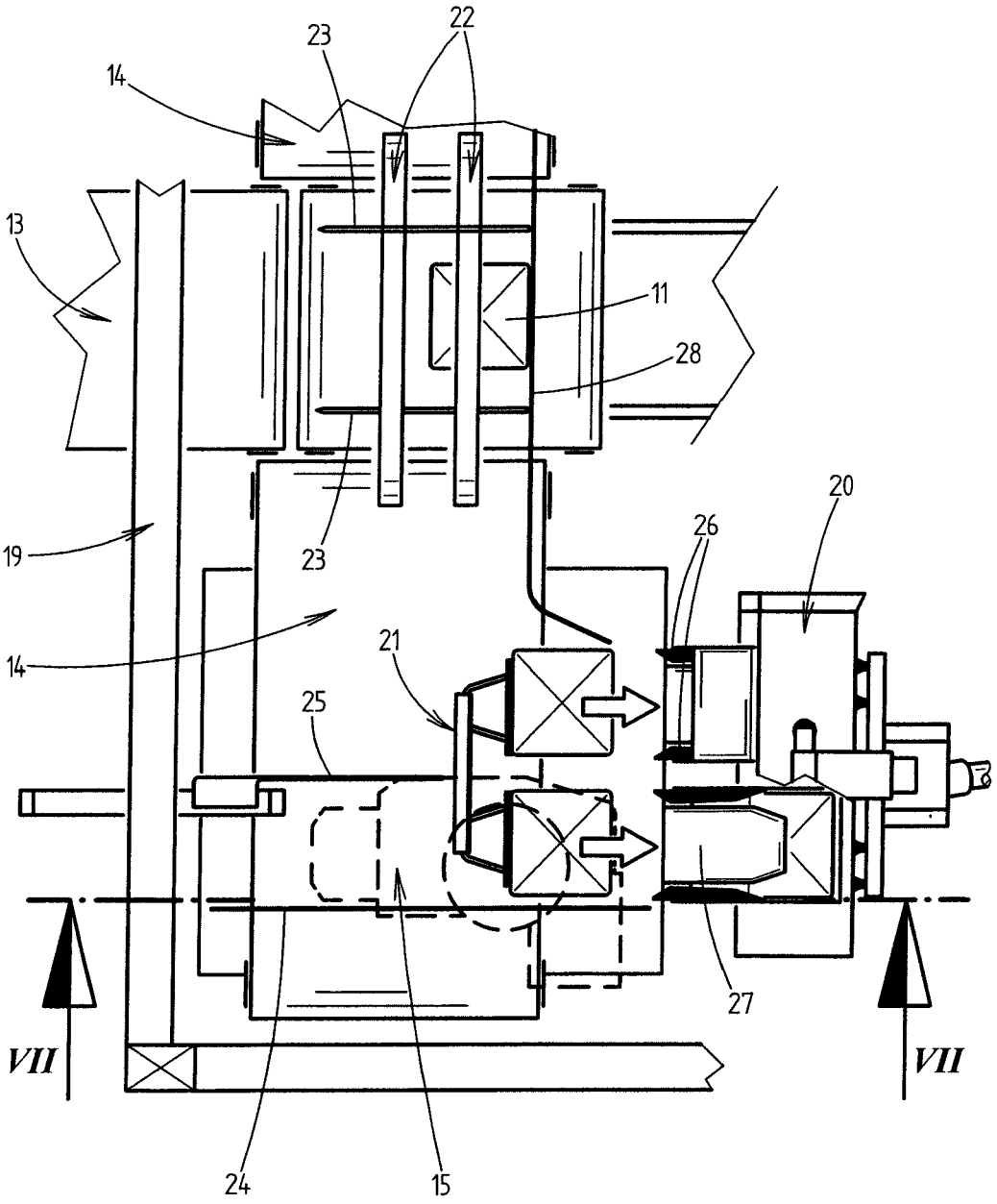
FIG. 6 shows a detail of the device according to the marking in FIG. 1.
Figure 7:
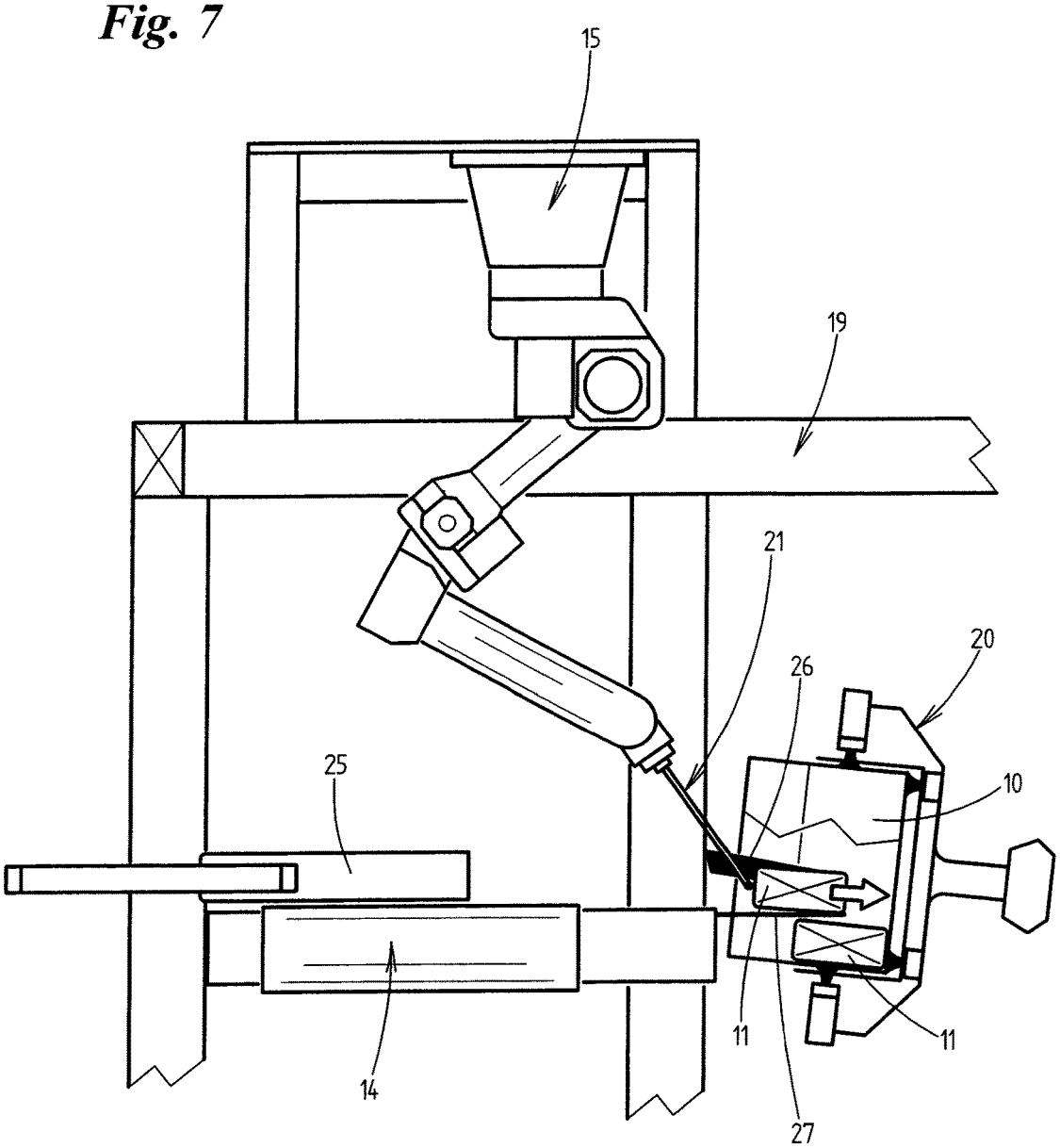
FIG. 7 shows a vertical section though the device along the line of intersection VII-VII in FIG. 6.

The details of conveying the packages 11 into the cardboard boxes 10 is shown in FIGS. 5 to 7. It can also be seen from FIG. 6 that a further fixed stop 28 is provided at the end of the feed conveyor 13, the packages 11 running up against said fixed stop at the end of the feed conveyor 13 before they are conveyed away in a lateral manner by the cross conveyor 22.

A further characteristic relates to the operation of holding the cardboard boxes 10 ready to be received by a cardboard box robot 16. They are held ready in a region of the cardboard box station 17, namely at the end of the feed conveyor 12. By means of gripping members 29, 30, two cardboard boxes 10 are held ready at a spacing with respect to one another in such a manner that said cardboard boxes are able to be grasped by the gripping head 20 of the cardboard box robot 16.

The two gripping members 29, 30 are mounted so as to be displaceable along a linear axis 31. More precisely, a first gripping member 29 is mounted so as to be movable by means of a slide 32 along the linear axis 31 in the longitudinal direction of said linear axis. The second gripping member 30, in turn, is mounted on the slide 32 by means of a slide 33 so as to be movable in the longitudinal direction of the linear axis 31. Over and above this, the gripping member 30 is mounted on the slide 33 so as to be displaceable along a vertical axis.

To supply two cardboard boxes 10 into the cardboard box station 17, first of all the gripping member 30 is raised such that a first cardboard box 10 is able to be moved along the feed conveyor 12 against the gripping member 29. Side walls of the cardboard box 10 are held against said gripping member via suction members 34 by means of negative pressure. After this, a further cardboard box 10 is conveyed into the cardboard box station 17 until it runs up against the cardboard box 10 already held by the gripping member 29 or abuts against said cardboard box. Then the second gripping member 30 is lowered in the vertical direction such that a suction member 34 of the gripping member 30 is first of all moved into the cardboard box 10 and then against an inner wall of the same.

In the next step, the two cardboard boxes 10 are moved into a defined spacing with respect to one another in the cardboard box station 17 such that the cardboard boxes 10 are able to be grasped by the gripping head 20 of the cardboard box robot 16. The spacing at which the cardboard boxes 10 have to be held ready also corresponds to the spacing between the individual sliders of the double slider 21 when filling the cardboard boxes 10.

The spacing apart of the cardboard boxes 10 is effected as a result of the gripping member 30 being moved in a corresponding manner along the linear axis 31 until the predefined spacing between the cardboard boxes 10 is produced. The cardboard boxes 10 are then grasped by the gripping head 20 of the cardboard box robot 16 and the negative pressure is shut-off such that the cardboard boxes 10 are no longer held by the suction members 34 but only still by the gripping head 20. The gripping member 30 is then removed out of the cardboard box 10 and the cardboard boxes 10 are moved at the same time or together by the cardboard box robot 16 for filling.

After filling, the cardboard boxes 10 are put onto the discharging conveyor 18 in the region of the cardboard box station 17 by the cardboard box robot 16 and conveyed away.

The two cardboard box robots 16 operate in an alternating manner so that when receiving the empty cardboard boxes 10 or when depositing the filled cardboard boxes 10, collisions are avoided.

It is obvious that the design of the device does not necessarily have to be realized with two lanes, each with two cardboard box robots 16 and two package robots 15. A single lane method of operation of the device is also conceivable. In addition, variants with a different number of package robots 15 and cardboard box robots 16 are conceivable, for example in dependence on the capacity of the handling devices or the complexity of the packaging operation.

LIST OF REFERENCES

10 Cardboard box
11 Package
12 Feed conveyor (cardboard box)
13 Feed conveyor (package)
14 Cross conveyor (package)
15 Package robot
16 Cardboard box robot
17 Cardboard box station
18 Discharging conveyor
19 Machine frame
20 Gripping head
21 Double slider
22 Cross conveyor
23 Entrainment means
24 Fixed stop (cross conveyor)
25 Sliding stop
26 Insertion aid
27 Insertion tongue
28 Fixed stop (feed conveyor)
29 Gripping member
30 Gripping member
31 Linear axis
32 Slide
33 Slide
34 Suction member

The invention claimed is:

1. A method for handling containers for groups of objects, comprising:

holding the containers by a cardboard box robot as a handling device, for the insertion of the objects into the containers; and inserting the objects one after another into the containers, whereby the objects are deposited in the containers in an ordered formation, and whereby the containers are filled with the objects, wherein the containers are grasped by the handling device at a spacing from one another, wherein the spacing between the containers with respect to one another when being held by the handling device corresponds to the spacing between the containers with respect to one another during the subsequent process for inserting the objects into the containers, wherein the containers are held by pneumatically operating gripping members when being held by the handling device so that the containers are grasped by the handling device, wherein the containers are first accumulated and grasped by the gripping member and are then moved to the spacing with respect to one another by means of corresponding movement of the gripping member, and wherein a respective one of the containers is grasped at an inner wall of the respective container by the gripping member, wherein the gripping member is displaced laterally so as to space the respective container from an adjacent one of the containers, and wherein as the gripping member is subsequently removed out of the respective container the gripping member is initially moved away from the inner wall of the respective container and then withdrawn from the respective container.

2. The method as claimed in claim 1, wherein the objects are supplied on a feed conveyor and are then shifted at an angle transversely on a cross conveyor, and in that, as a result of abutting against stops, the objects are held in the region of the cross conveyor at a spacing with respect to one another which corresponds to the spacing between containers.

3. The method as claimed in claim 2, wherein at least one stop is arranged in an immovable manner, and in that at least one further stop is arranged so as to be movable and is moved into the conveying path of the objects in order to position an object at a predefined spacing with respect to another object which abuts against the immovable stop.

4. The method as claimed in claim 1, wherein the objects are supplied on a central feed conveyor and are shifted onto two cross conveyors and from there are inserted into the containers, wherein each cross conveyor has associated therewith in each case one handling device, and the handling devices hold the containers for filling in an alternating manner and deposit the filled containers one after another on a conveying device for filled containers.

* * * * *